US010633157B2

(12) United States Patent
Lee

(10) Patent No.: US 10,633,157 B2
(45) Date of Patent: Apr. 28, 2020

(54) AIRTIGHT CONTAINER HAVING DEFORMABLE COVER UNIT OR DEFORMABLE CONTAINER UNIT

(71) Applicant: Hyun-Seung Lee, Hanam-si (KR)

(72) Inventor: Hyun-Seung Lee, Hanam-si (KR)

( * ) Notice: Subject to any disclaimer, the term of this patent is extended or adjusted under 35 U.S.C. 154(b) by 243 days.

(21) Appl. No.: 15/511,242

(22) PCT Filed: Oct. 21, 2015

(86) PCT No.: PCT/KR2015/011106
§ 371 (c)(1),
(2) Date: Mar. 15, 2017

(87) PCT Pub. No.: WO2016/064176
PCT Pub. Date: Apr. 28, 2016

(65) Prior Publication Data

US 2017/0283140 A1 Oct. 5, 2017

(30) Foreign Application Priority Data

Oct. 21, 2014 (KR) ..... 10-2014-0142707
Oct. 21, 2014 (KR) ..... 10-2014-0142759

(51) Int. Cl.
*B65D 65/08* (2006.01)
*B65D 33/02* (2006.01)
(Continued)

(52) U.S. Cl.
CPC ..... *B65D 65/08* (2013.01); *B65D 21/08* (2013.01); *B65D 33/02* (2013.01); *B65D 43/14* (2013.01);
(Continued)

(58) Field of Classification Search
CPC ..... B65D 65/08; B65D 33/02; B65D 65/38; B65D 65/06; B65D 65/22; B65D 43/14;
(Continued)

(56) References Cited

U.S. PATENT DOCUMENTS 530,599 A * 12/1894 Von Oheimb ..... A45C 9/00 190/1
3,555,663 A * 1/1971 Forman ..... B63B 3/13 220/2.3 R
(Continued)

FOREIGN PATENT DOCUMENTS

JP 3022214 U 12/1995
JP 2542350 Y2 4/1997
(Continued)

OTHER PUBLICATIONS

International Search Report in International Application No. PCT/KR2015/011106, dated Feb. 3, 2016.

*Primary Examiner* — James N Smalley
(74) *Attorney, Agent, or Firm* — Park, Kim & Suh, LLC

(57) ABSTRACT

Disclosed is an airtight container having a deformable cover unit or a deformable container unit, which ensures easy maintenance of the cover unit and allows the cover unit to be easily used with a large-capacity fixed container unit, or which includes an expandable accommodating space or an expandable inlet to accommodate various sizes of storage items therein in an airtight manner. The airtight container includes a deformable cover unit for useable with a fixed container unit. Alternatively, the airtight container includes first and second frames pivotably connected to each other so as to be selectively coupled to or come into contact with each other in order to seal a contact or coupling portion therebetween, and a deformable container unit disposed over the frames and configured to provide an accommodating space for a storage item therein. The first and second frames are disposed along the inlet rim of the container unit.

17 Claims, 10 Drawing Sheets

(51) Int. Cl.

| | |
|---|---|
| ***B65D 21/08*** | (2006.01) |
| ***B65D 43/22*** | (2006.01) |
| ***B65D 43/14*** | (2006.01) |
| ***B65D 51/00*** | (2006.01) |
| ***B65D 55/02*** | (2006.01) |
| ***B65D 65/06*** | (2006.01) |
| ***B65D 65/22*** | (2006.01) |
| ***B65D 65/38*** | (2006.01) |
| *B65D 65/14* | (2006.01) |

(52) U.S. Cl.
CPC ..... *B65D 43/22* (2013.01); *B65D 51/00* (2013.01); *B65D 55/02* (2013.01); *B65D 65/06* (2013.01); *B65D 65/22* (2013.01); *B65D 65/38* (2013.01); *B65D 65/14* (2013.01); *B65D 2543/0037* (2013.01); *B65D 2565/381* (2013.01)

(58) Field of Classification Search
CPC ..... B65D 55/02; B65D 43/22; B65D 51/00; B65D 21/08; B65D 65/14; B65D 2543/0037; B65D 2565/381

USPC ..... 220/4.21–4.23, 287, 252, 826, 324; 383/4, 34, 118; 229/87.03, 87.08

See application file for complete search history.

(56) References Cited

U.S. PATENT DOCUMENTS

| | | | | | |
|---|---|---|---|---|---|
| 4,270,668 | A * | 6/1981 | Berfield | A47L 9/00 | 220/324 |
| 4,561,480 | A * | 12/1985 | Underwood | A01G 20/30 | 383/34 |
| 4,996,727 | A * | 3/1991 | Wyatt | A47K 11/105 | 383/34 |
| 5,451,107 | A * | 9/1995 | Ricker | A01G 20/30 | 383/10 |
| 5,542,560 | A * | 8/1996 | Gerster | A47G 19/26 | 126/299 C |
| 6,186,640 | B1 * | 2/2001 | Typaldos | A45C 3/06 | 135/133 |
| 6,212,711 | B1 * | 4/2001 | Gilmour | A45C 9/00 | 190/1 |
| 6,431,393 | B1 * | 8/2002 | Stewart | B65D 33/02 | 220/213 |
| 7,243,482 | B2 * | 7/2007 | Bezar | B65D 13/04 | 206/457 |
| 7,243,809 | B2 * | 7/2007 | Bezar | B65D 81/36 | 206/457 |
| 2002/0130127 | A1 * | 9/2002 | Stewart | B65D 33/02 | 220/9.2 |
| 2013/0334241 | A1 * | 12/2013 | Abdi | B65D 25/287 | 220/826 |

FOREIGN PATENT DOCUMENTS

| | | |
|---|---|---|
| KR | 20-0386516 Y1 | 6/2005 |
| KR | 20-0396084 Y1 | 9/2005 |
| KR | 20-0400652 Y1 | 11/2005 |
| KR | 20-0448463 Y1 | 4/2010 |

* cited by examiner

AIRTIGHT CONTAINER HAVING DEFORMABLE COVER UNIT OR DEFORMABLE CONTAINER UNIT

CROSS-REFERENCE TO RELATED APPLICATIONS

This application is the National Stage filing under 35 U.S.C. 371 of International Application No. PCT/KR2015/011106, filed on Oct. 21, 2015, which claims the benefit of Korean Patent Application No. 10-2014-0142707, filed on Oct. 21, 2014, and Korean Patent Application No. 10-2014-0142759, filed on Oct. 21, 2014, the contents of which are all hereby incorporated by reference herein in their entirety.

BACKGROUND OF THE INVENTION

Field of the Invention

The present invention relates to an airtight container having a deformable cover unit or a deformable container unit, and more particularly, to an airtight container having a deformable cover unit, which may ensure easy maintenance of the deformable cover unit and may allow the cover unit, which has a deformable shape, to be easily used with a large-capacity container unit, which has a fixed shape.

In addition, the present invention relates to an airtight container having a deformable container unit, which includes an expandable accommodating space and an expandable inlet, thereby allowing various sizes of storage items to be accommodated and stored therein in an airtight manner.

Description of the Related Art

Airtight containers are often used to keep foods and food materials, such as fruits and vegetables, fresh by blocking external contaminants.

Such airtight containers are also widely used to store not only foods, but also other objects that need to be stored in an airtight condition.

A general airtight container includes a container body, which is formed in a particular shape from metal, glass or plastic, and a cover, which is formed from metal, glass or plastic and is configured to cover the container body in an airtight manner. A sealing member, which is formed of silicon or rubber, is provided on the lower rim of the cover.

Such an airtight container is disclosed in Korean Utility Model Registration No. 20-0396084.

The disclosed airtight container, however, has the following inconveniences. Because a cover needs to be separated and placed near a body when in use, the cover may become contaminated when it is placed in a contaminated location, and it may be difficult to find the cover when a user does not manage the cover well.

In addition, because the cover or the container has a fixed shape, it is impossible to store an object that has a higher height than the container in an airtight manner.

In addition, in the case of a container such as a pot or a pan, a cover thereof is usually formed of a piece of glass or metal having a large thickness, and the size and weight of the cover is increased in conformity with the large size of the pot or the pan. In particular, a glass cover may cause an accident when it is damaged, and the pot or the pan may need to be used alone without the cover when the cover is damaged.

Meanwhile, in the case of a bag-type container such as a Ziploc bag, there is a limit to opening the inlet of the bag-type container and it is difficult to place a large object, such as a watermelon, therein. In addition, this type of container is not elastically deformed and thus has a limitation on the shape of an object that can be stored therein, and because the inlet does not have a fixed shape, a user needs to hold the inlet open while placing the object into the container, which is inconvenient.

SUMMARY OF THE INVENTION

Therefore, the present invention has been made in view of the above problems, and it is one object of the present invention to provide an airtight container, which includes a cover unit having a deformable shape, a portion of the deformable cover unit being fixed to a container unit and a remaining portion of the cover unit being configured to be opened away from or closed to the container, which may prevent contamination of the cover unit due to separation of the cover unit and may ensure easy maintenance of the cover unit.

In addition, it is another object of the present invention to provide an airtight container, which allows a deformable cover unit to be applied to a large-capacity container unit, such as a pot or a pan, instead of a heavy glass or metal cover unit, thereby promoting safe use and easy maintenance of the cover unit.

In addition, it is still another object of the present invention to provide an airtight container, in which a container unit, which provides a space in which a storage item is accommodated, has a deformable shape and an inlet of the storage space is expandable.

In addition, it is a further object of the present invention to provide an airtight container, in which the rim of an inlet of a deformable container unit is supported by a rigid frame so that the inlet is deformable in shape while maintaining a required strength.

TECHNICAL SOLUTION

In accordance with one aspect of the present invention, to accomplish the above and other objects, there is provided an airtight container having a deformable cover unit, the container including a container unit having a storage space therein, and an airtight cover unit provided attachably to or detachably from the container unit so as to selectively seal the storage space inside the container unit from an outside, wherein the airtight cover unit includes a first cover frame configured to be fixed and installed to a partial rim region of an inlet of the container unit, a second cover frame located close to or connected to the first cover frame so as to selectively come into close contact with or be spaced apart from a remaining rim region of the inlet of the container unit, and a cover member provided over the first cover frame and the second cover frame and having a shape that is deformable depending on movement of the second cover frame, the cover member being configured to selectively open or close the inlet of the container unit and being formed of a material that prevents penetration of liquid or gas.

The airtight container may further include a first fixing portion provided on a side surface of the container unit, and a first connection portion connected to the first cover frame so as to be caught by or fastened to the first fixing portion, the first connection portion being configured to fix the first cover frame to a rim of the inlet of the container unit.

The airtight container may further include a second fixing portion provided on a side surface of the container unit and spaced apart from the first fixing portion, and a second connection portion connected to the second cover frame so as to be caught by or fastened to the second fixing portion, the second connection portion being configured to fix the second cover frame to the rim of the inlet of the container unit when the cover member closes the inlet of the container unit.

The first fixing portion and the second fixing portion may each have a boss shape, and the first connection portion and the second connection portion may each have a hook shape.

The first connection portion may be pivotably installed to the first cover frame, and the second connection portion may be pivotably installed to the second cover frame.

The first cover frame may have a shape corresponding to a shape of the partial rim region of the inlet of the container unit, to which the first cover frame is fixed, and the second cover frame may have a shape corresponding to a shape of the remaining rim region of the inlet of the container unit, with which the second cover frame may come into close contact.

The cover member may be formed of an elastic material.

The cover member may be folded when the second cover frame is moved away from a rim of the inlet of the container unit to thereby be tilted toward the first cover frame, and the cover member may be unfolded when the second cover frame comes into close contact with the rim of the inlet of the container unit.

The airtight container may further include a reinforcement member connected to the first cover frame or the second cover frame and disposed on a surface of the cover member or inside the cover member to increase a strength of the cover member, and the reinforcement member may be provided in a plural number so that a plurality of reinforcement members is spaced apart from each other.

At least a portion of the first cover frame and the second cover frame may include a viscous component or an elastically deformable component so that the first cover frame and the second cover frame come into close contact with the rim of the inlet of the container unit.

In accordance with another aspect of the present invention, there is provided an airtight container having a deformable container unit, the container including a first frame and a second frame pivotably connected to each other so as to be selectively coupled to or come into close surface contact with each other, the first frame and the second frame being configured to airtightly seal a surface contact portion or a coupling portion therebetween when coming into surface contact with or coupled to each other, and a deformable container unit disposed over the first frame and the second frame and configured to provide an accommodating space for accommodating a predetermined storage item therein, the container unit having a deformable shape, wherein the first frame and the second frame are disposed along a rim of an inlet of the container unit.

The container unit may be formed as an elastic or non-elastic bag so as to be deformable in shape, and may be formed of a member that does not transmit liquid or gas.

The airtight container may further include a connection-supporting portion configured to pivotably connect the first frame and the second frame to each other.

A sum of a thickness of the first frame and a thickness of the second frame may be equal to or greater than a length of an upper surface of the connection-supporting portion.

The airtight container may further include a fixing portion provided on any one of the first frame and the second frame, and a connection portion connected to a remaining one of the first frame and the second frame so as to be caught by or fastened to the fixing portion.

The fixing portion may protrude to extend outward, and the connection portion may be pivotably provided on any one of the first frame and the second frame so as to be caught by or fastened to the fixing portion.

At least a portion of the first frame and the second frame may include a viscous component or an elastically deformable component so that the first frame and the second frame come into close contact with each other.

Advantageous Effects

As is apparent from the above description, in an airtight container according to the present invention, because a cover unit is attached to a container unit, there is no risk of the cover unit being placed in a contaminated location and becoming contaminated.

In addition, because the cover unit is flexible and is deformable in shape, it is possible to place and store an object, which is taller than the container, in an airtight condition.

In particular, in the case where a cover member is an elastic rubber or silicon member or is a plastic member that may provide an extra space, even if the upper end of a storage item is higher than the upper end of an inlet of the container unit and protrudes upward from the container unit, the shape of the cover member may be deformed so as to correspond to the protruding shape of the storage item.

The cover unit includes a first cover frame configured to be fixed to the rim of the inlet of the container unit and a second cover frame configured to be pivotably opened or closed. As such, when the container unit is opened via the pivotable movement of the second cover frame in the state in which the first cover frame is fixed to the rim of the inlet, the entire inlet of the container unit may be used as an introduction opening, which may advantageously allow the storage item to be placed into or retrieved from the container unit through the introduction opening without separating the cover unit from the container unit.

Meanwhile, with another aspect of the present invention, by providing first and second frames, which are pivotably connected to each other and are configured to maintain the shape thereof, and connecting a container unit, which has a deformable shape, to the frames, it is possible to store various sizes of storage items in the container in an airtight manner.

In particular, in the case where the container unit is formed of an elastic material that does not transmit liquid or gas, the storage item may be stored to maintain the original shape thereof in an airtight manner while overcoming a limitation on the size of the storage item.

In addition, through adjustment of the distance between the first and second frames, the size of the inlet of the container unit may be adjusted.

In addition, because the first frame and the second frame maintain a predetermined shape, when attempting to accommodate the storage item in the container unit, no effort to open the inlet and to keep the inlet in the open state is necessary, which may increase user convenience.

In the case where the first and second frames are wholly or partially formed of an elastic material or an adhesive material and come into surface contact with each other, the excellent airtight state may be maintained. In addition, in the case where the first frame and the second frame are provided with a fixing portion and a connection portion respectively so that the fixing portion and the connection portion are fastened to, coupled to, or caught by each other, the first and second frames are likely to come into closer contact with each other, which may further increase the reliability of air-tightness of the inside of the container unit from the outside.

In addition, when the airtight container is washed, the container unit may be everted, which may ensure easier and rapid washing.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

The advantages and features of the present invention and the way of attaining them will become apparent with reference to embodiments described below in detail in conjunction with the accompanying drawings.

The present invention, however, are not limited to the embodiments disclosed hereinafter and may be embodied in many different forms. Rather, these exemplary embodiments are provided so that this disclosure will be through and complete and will fully convey the scope to those skilled in the art. The scope of the present invention should be defined by the claims.

In addition, the terms used in this specification are provided to describe the embodiments and are not intended to limit the present invention.

In this specification, the singular forms are intended to include the plural forms as well, unless the context clearly indicates otherwise. It will be further understood that the terms "comprises" and/or "comprising", when used in this specification, specify the presence of stated elements, but do not preclude the presence or addition of one or more other elements.

Unless otherwise defined, all terms (including technical and scientific terms) used herein have the same meaning as commonly understood by one of ordinary skill in the art to which example embodiments belong.

Hereinafter, in order to more concretely describe the present invention, the embodiments of the present invention will be described in more detail with reference to the accompanying drawings.

Figure 1:
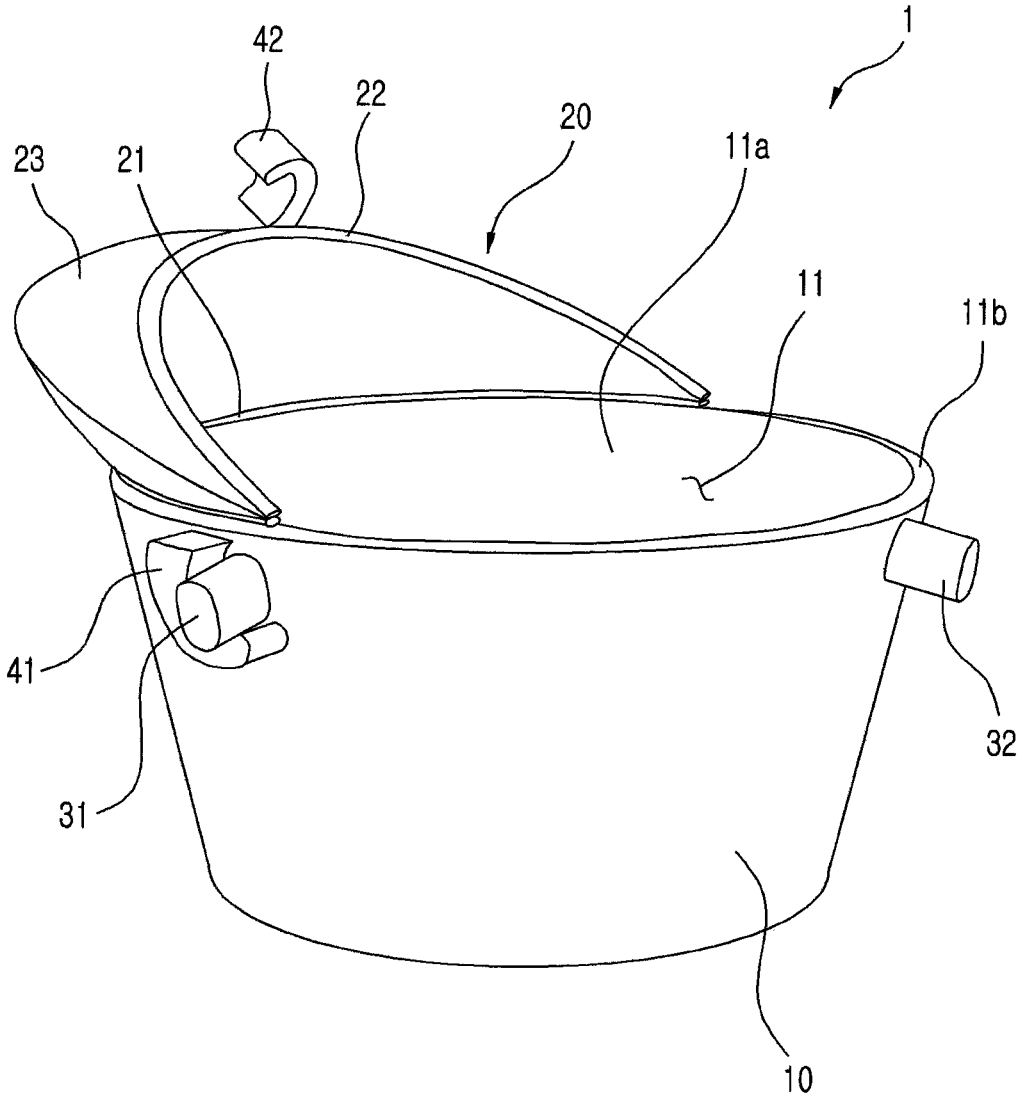
FIG. 1 is a perspective view illustrating an airtight container having a deformable cover unit according to the present invention.

As illustrated in FIG. 1, the airtight container 1 according to the present invention includes a fixed container unit 10, and a cover unit 20, which is disposed on the rim of an inlet 11 of the container unit 10.

The container unit 10 is formed of a metal, a polymer material such as a synthetic resin, or glass, has a fixed shape, and defines an accommodating space having a rated capacity therein.

The cover unit 20 includes a first cover frame 21, which may be fixedly installed to a partial rim region 11*a* of the inlet 11 of the container unit 10, and a second cover frame 22, which may be fixed to or separated from a remaining rim region 11*b* of the inlet 11 of the container unit 10.

The ends of the first cover frame 21 and the second cover frame 22 may be connected to each other, or may be located close to each other without connection therebetween.

Each of the first cover frame 21 and the second cover frame 22 has the same shape as the corresponding partial rim region 11*a* or the corresponding remaining rim region 11*b* of the inlet 11 of the container unit 10.

The cover unit 20 further includes a cover member 23, which may overlap the first cover frame 21 and the second cover frame 22 so as to cover the inlet 11 of the container unit 10.

The cover member 23 may be formed of an elastic material, like a rubber member or a silicon member, or may be formed of a non-elastic material, like a plastic member. The cover member 23 may be formed of any other material so long as it has a shape so as to be folded or unfolded depending on the positional displacement of the second cover frame 22.

The first cover frame 21 and the second cover frame 22 may have a rib shape or a grate shape.

In order to allow the first cover frame 21 and the second cover frame 22 to come into close contact with the rim of the inlet 11 of the container unit 10, the first cover frame 21 and the second cover frame 22 may be formed of a viscous material or an elastically deformable material.

Meanwhile, unlike the second cover frame 22, the first cover frame 21 needs to be continuously fixed to the partial rim region 11*a* of the inlet 11 of the container unit 10.

Accordingly, the partial rim region 11*a* of the inlet 11 of the container unit 10 may be provided with a stepped portion (not illustrated), and the first cover frame 21 may be provided with a groove or a corresponding coupling stepped portion for coupling with the stepped portion of the partial rim region 11*a*.

In addition, the remaining rim region 11*b* of the inlet 11 of the container unit 10 may be provided with a stepped portion (not illustrated), and the second cover frame 22 may be provided with a groove or a corresponding coupling stepped portion for coupling with the stepped portion of the remaining rim region 11*b*.

Meanwhile, an additional fixing structure is provided to stably couple the first cover frame 21 to the container unit 10.

The fixing structure includes a first fixing portion 31, which takes the form of a protrusion or a boss formed on the side surface of the container unit 10, and a first connection portion 41, which is connected to the first cover frame 21 so as to be caught by, connected to, or fastened to the first fixing portion 31.

Although FIG. 1 illustrates that the first connection portion 41 has a hook shape so as to be caught by the first fixing portion 31 and that the first fixing portion 31 has a small boss shape that protrudes laterally, the first connection portion 41 and the first fixing portion 31 may have any other shapes so long as they may be connected or fastened to each other so as to continuously remain in the connected or fastened state.

A plurality of first fixing portions 31 may be spaced apart from one another on the container unit 10. This description is equally applicable to the first connection portion 41.

With the coupling of the first fixing portion 31 and the first connection portion 41, the first cover frame 21 and the partial rim region 11*a* of the inlet 11 of the container unit 10 may achieve stronger close contact therebetween.

Meanwhile, the first connection portion 41 may be pivotably connected to the first cover frame 21, in order to be easily coupled to the first fixing portion 31.

That is, the first connection portion 41 may be outwardly tilted before it is coupled to the first fixing portion 31, and then may be moved toward the first fixing portion 31 in order to be coupled to the first fixing portion 31.

Meanwhile, another fixing structure may be provided to maintain close contact between the second cover frame 22 and the remaining rim region 11*b* of the inlet 11 of the container unit 10 when the cover member 23 completely closes the inlet 11 of the container unit 10.

To this end, a second fixing portion 32 is provided on the side surface of the container unit 10, and a second connection portion 42 is connected to the second cover frame 22.

The second connection portion 42 is configured so as to be fastened to, caught by, or coupled to the second fixing portion 32.

In one example, as illustrated in FIG. 1, although the second fixing portion 32 may have a protruding boss shape and the second connection portion 42 may have a hook shape, the second fixing portion 32 and the second connection portion 42 may have any other shape so long as they may be connected or fastened to each other so as to continuously remain in the connected or fastened state.

Meanwhile, the second connection portion 42 may be pivotably connected to the second cover frame 22, in order to be easily fastened to, caught by, or connected to the second fixing portion 32.

That is, the second connection portion 42 may be outwardly tilted before it is coupled to the second fixing portion 32, and then may be moved toward the second fixing portion 32 in order to be coupled to the second fixing portion 32.

In order to put or take a storage item into or from the container unit 10, the second cover frame 22 may be moved away from the rim of the inlet 11 of the container unit 10, and may be tilted toward the first cover frame 21.

In this case, the cover member 23, which has a free-formed or deformable shape, may be folded, or may be bent.

In particular, the second cover frame 22 may be completely folded to the upper side of the first cover frame 21. This is possible because the cover member 23 is configured as a thin plastic (or vnyl) member or a thin rubber or silicon member. Thereby, the inlet 11 of the container unit 10 may be fully opened.

Accordingly, the cover member 23 does not prevent a user from putting or taking an object into or from the container unit 10.

Figure 2:
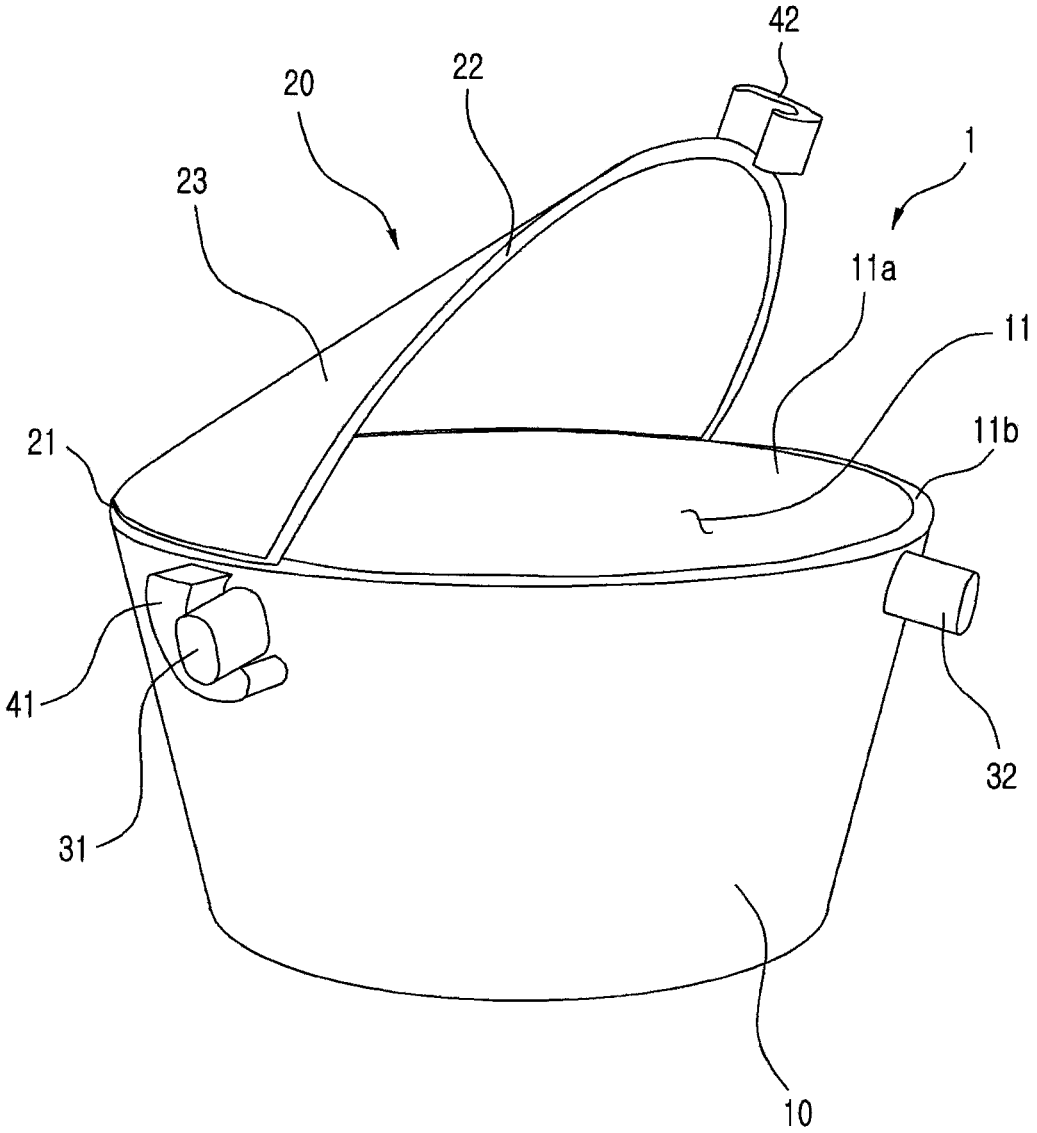
FIGS. 2 and 3 are views illustrating a process of closing the deformable cover unit according to the present invention.

Meanwhile, when it is desired to again seal the container unit 10 after completely putting or taking the object into or from the container unit 10, as illustrated in FIG. 2, the user needs to grip and move the second cover frame 22 toward the remaining rim region 11*b* of the inlet 11 of the container unit 10.

Figure 3:
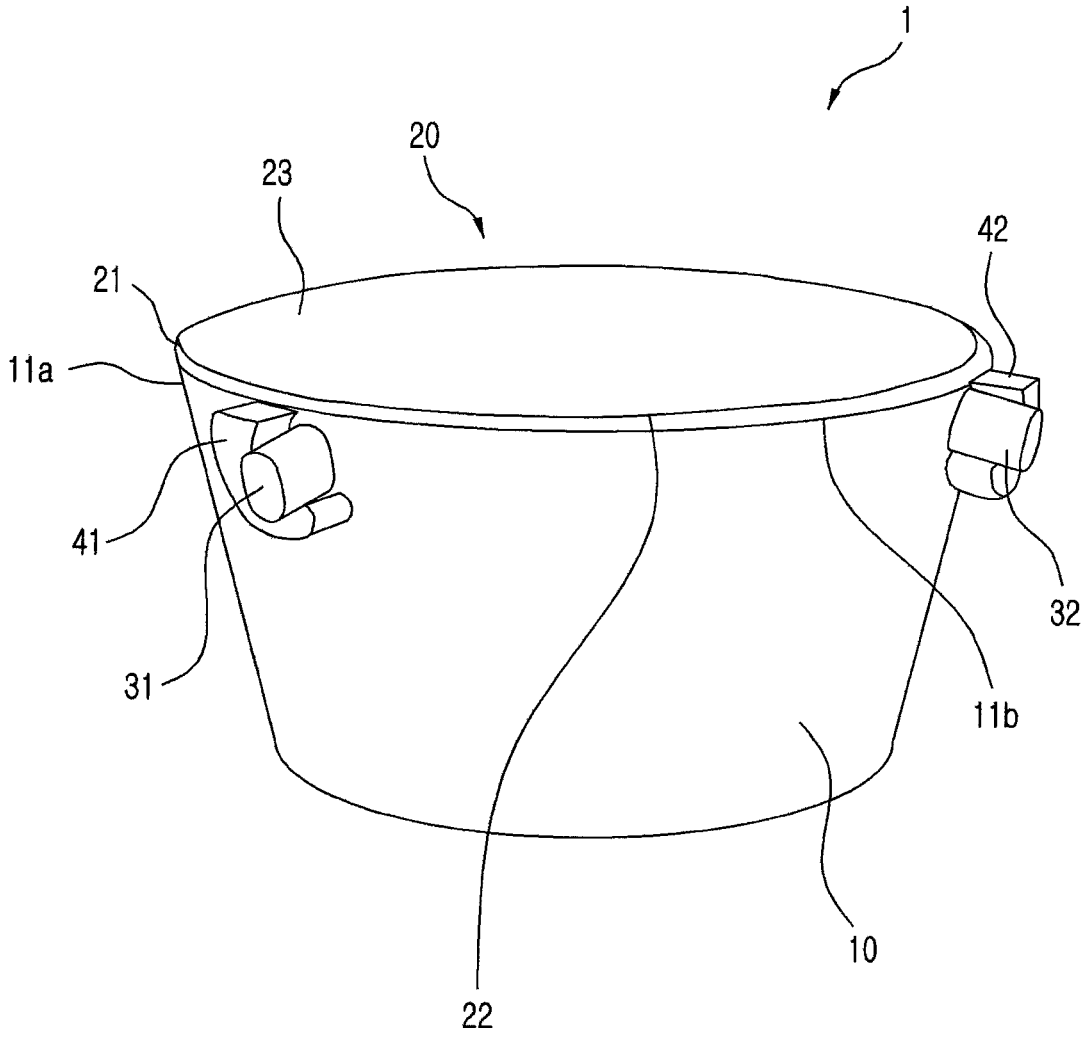

Subsequently, as illustrated in FIG. 3, the user needs to strongly push the second cover frame 22 so that the second cover frame 22 comes into close contact with or is coupled to the remaining rim region 11*b* of the inlet 11 of the container unit 10. Thereafter, the second connection portion 42 may be coupled to, connected to, fastened to, or caught by the second fixing portion 32.

In this way, the entire lower surface of the second cover frame 22 may come into close contact with the rim of the inlet 11 of the container unit 10. This close contact state may be strengthened when the second fixing portion 32 is coupled to, connected to, fastened to, or caught by the second connection portion 42.

The close contact state may further be improved when an increased number of the second fixing portions 32 and the second connection portions 42 are fastened to each other.

Subsequently, the cover member 23, which has been folded as illustrated in FIG. 1, may be unfolded to close the inlet 11 of the container unit 10 in an aesthetically pleasing shape.

Meanwhile, in the case where the cover member 23 is an elastic rubber or silicon member, or a plastic (or vinyl) member that may provide an extra space, even if the upper end of a storage item is higher than the upper end of the inlet 11 of the container unit 10 to thereby protrude upward from the container unit 10, the shape of the cover member 23 may be deformed so as to correspond to the protruding shape of the storage item.

In addition, because the cover member 23 has elasticity, when the cover member 23 is slightly pushed, air inside the container unit 10 may be discharged outward, which further improves the airtight state inside the container unit 10.

Figure 4:
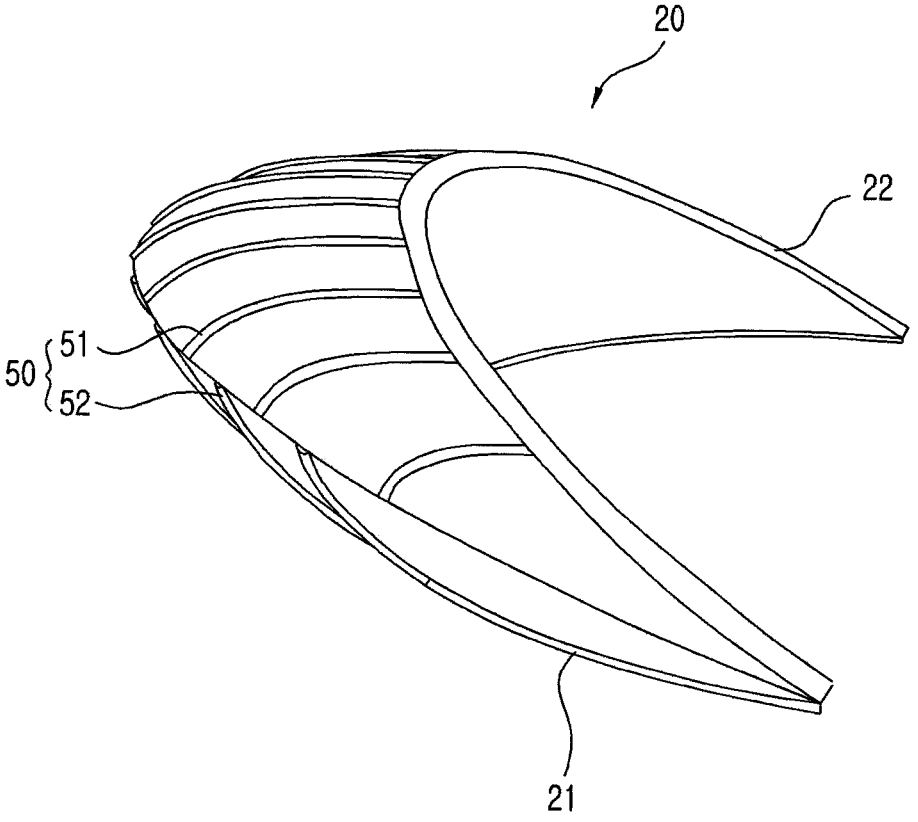
FIG. 4 is a view illustrating a reinforcement member provided in the deformable cover unit according to the present invention.

Meanwhile, as illustrated in FIG. 4, in order to increase the strength of the cover member 23, an additional reinforcement member 50 may be provided.

In FIG. 4, the container unit, the first and second fixing portions, and the first and second connection portions are not illustrated for convenience.

Although the reinforcement member 50 may take the form of a rib or grate structure, which is connected to the first cover frame 21 or the second cover frame 22, the present invention is not limited thereto, and any other structure may be provided so long as it may reinforce the cover member 23.

Here, a plurality of reinforcement members 50 may be spaced apart from one another, and may be connected to the first cover frame 21 or the second cover frame 22.

In FIG. 4, first reinforcement members 51, which are connected to the first cover frame 21, and second reinforcement members 52, which are connected to the second cover frame 22, may be alternately arranged. This arrangement serves to allow the cover member 23 to be easily folded.

Of course, each first reinforcement member 51 and each second reinforcement member 52 may meet each other so as to be connected to each other. In this case, the connection region between the second reinforcement member 52 and the first reinforcement member 51 may be provided with a folding portion (not illustrated) for easy folding of the cover member 23.

The reinforcement members 50 described above may be disposed on the surface of the cover member 23, or may be inserted into the cover member 23.

Meanwhile, since the reinforcement members 50 exist, user may place a light thing on the cover member 23.

Figure 5:
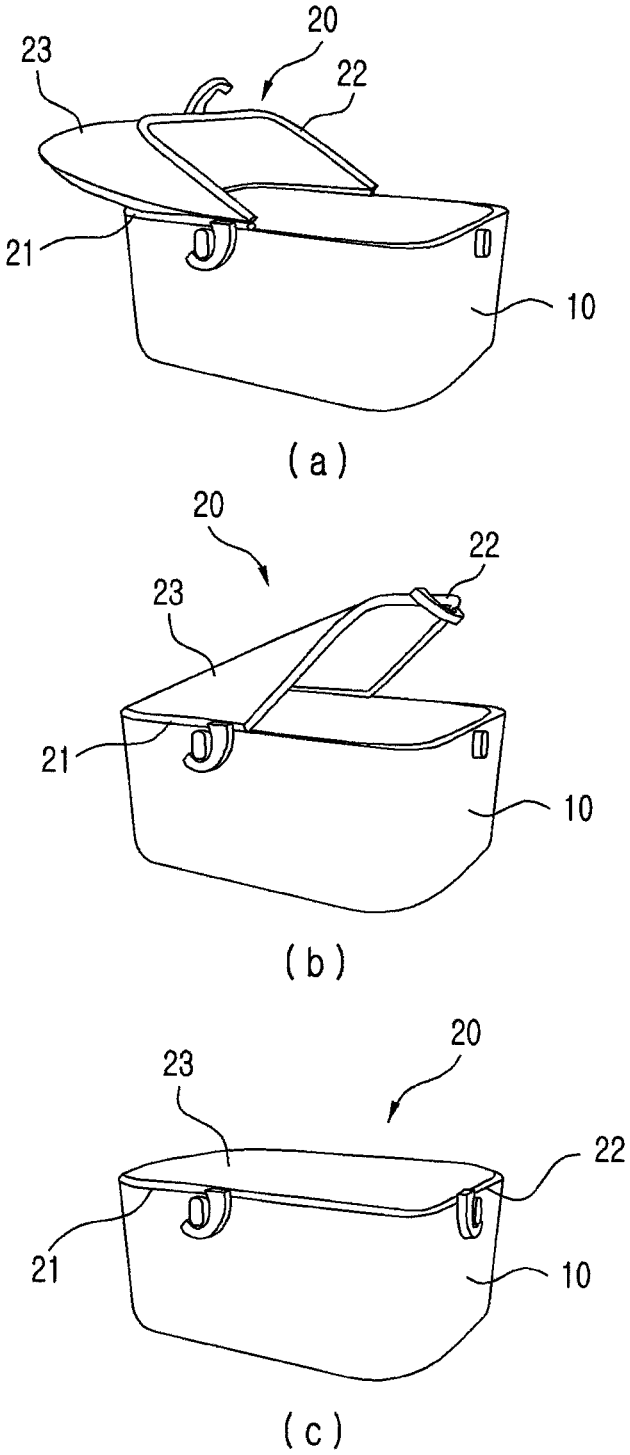
FIG. 5 is a perspective view illustrating the case where the deformable cover unit of the present invention is applied to various container units each having a different shape from that of FIG. 1.

FIGS. 5A to 5C illustrate that the container unit 10 takes the form of a square box, rather than a circular cylinder. With the exception that the container unit 10 has a square box shape, the configuration and operation of the cover unit 20 and the ability to install the reinforcement members are identical to the case illustrated in FIGS. 1 to 4, and thus a detailed description is obviated, with reference to be made instead to the above description.

The container unit 10 may have any of various other shapes, instead of a circular cylinder shape or a square box shape.

Figure 6:
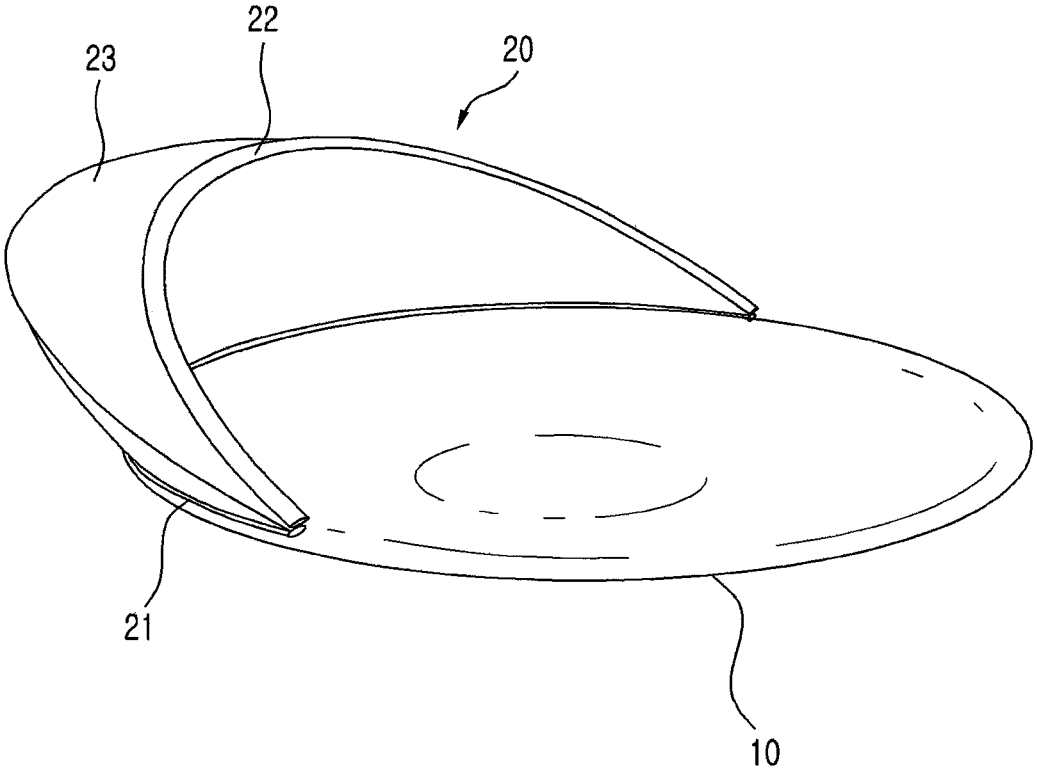
FIG. 6 is a perspective view illustrating the case where the deformable cover unit of the present invention is applied to a dish.

FIG. 6 illustrates that the container unit 10 has a dish shape.

In the case of a dish, unlike the container unit having a predetermined height illustrated in FIGS. 1 to 5, the possibility of utilizing the side surface of the dish may be very small.

Accordingly, in the configuration of the cover unit 20 illustrated in FIGS. 1 to 4, the first and second fixing portions 31 and 32 and the first and second connection portions 41 and 42 may be omitted, and the first and second cover frames 21 and 22 and the cover member 23 may be used in priority.

The configurations of the cover member 23, the first and second cover frames 21 and 22, and the reinforcement members 50 illustrated in FIGS. 1 to 4 may be directly applied to the cover unit 20 for use with the dish illustrated in FIG. 6.

Accordingly, because the shapes, materials, interactive operations, and connection relationships are the same as the description made with reference to FIGS. 1 to 4, in order to avoid a repeated description, reference is to be made to the corresponding description with reference to FIGS. 1 to 4.

Hereinafter, an airtight container having a deformable container unit will be described.

Figure 7:
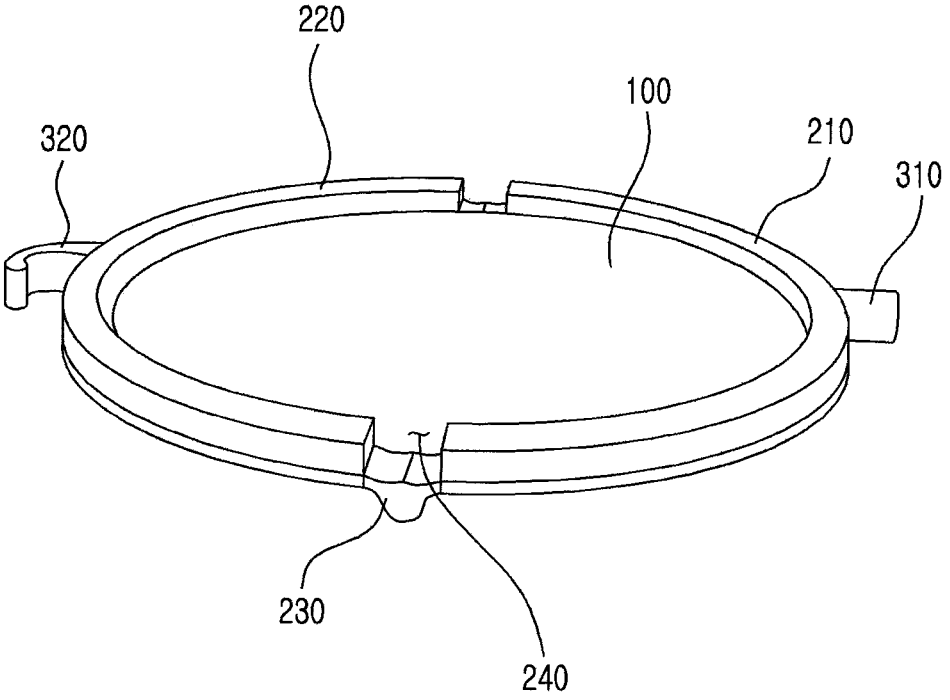
FIG. 7 is a perspective view illustrating an airtight container having a deformable container unit according to an embodiment of the present invention.

As illustrated in FIG. 7, the airtight container according to the present invention includes a deformable container unit 100, and a first frame 210 and a second frame 220 disposed on an inlet of the container unit 100.

The container unit 100 may be configured as an elastic rubber or silicon member, or may be a non-elastic plastic bag.

Although the arrangement of the first frame 210 and the second frame 220 may have a ring shape, the present invention is not limited thereto, and may have any other shape so long as the first frame 210 and the second frame 220 form a closed loop.

The first frame 210 and the second frame 220 may be pivotably connected to each other. To this end, each of the first frame 210 and the second frame 220 is connected to and pivotably supported by a connection-supporting portion 230.

That is, when the first frame 210 and the second frame 220 are tilted away from each other, they are spaced apart from each other, thereby defining a space 240. The space 240 may provide the space in which the first and second frames 210 and 220 may come into close contact with each other when they meet each other.

Meanwhile, because each of the first frame 210 and the second frame 220 is similar to a reinforcement member having a fixed shape, when the container unit 100 is opened, the rim of the inlet may maintain a consistent shape by the first frame 210 and the second frame 220.

In FIG. 7, the first frame 210 is provided with a fixing portion 310 having a boss or protrusion shape, and the second frame 220 is provided with a connection portion 320, which may be connected to, coupled to, or fastened to the fixing portion 310.

The connection portion 320 is pivotably connected to the second frame 220 in a hook shape. As such, the connection portion 320 may be configured so as to be connected to, coupled to, or fastened to the fixing portion 310 when the first frame 210 and the second frame 220 come into close contact with each other, in order to continuously maintain the close contact state.

When the first frame 210 and the second frame 220 meet each other to thereby come into close contact with each other, the inside of the container needs to be sealed from the outside.

To this end, a portion of the first frame 210 or the entire first frame 210, in particular, the surface of the first frame 210 that meets the second frame 220 may be formed of a viscous material, or an elastically deformable material.

In addition, a portion of the second frame 220 or the entire second frame 220, in particular, the surface of the second frame 220 that meets the first frame 210 may be formed of a viscous material, or an elastically deformable material.

In FIG. 7, although the surfaces of the first frame 210 and the second frame 220 that meet each other are illustrated as being flat surfaces, any one of the first frame 210 and the second frame 220 may be provided along the surface thereof with a continuous protrusion (not illustrated), and the other one may be provided along the surface thereof with a continuous groove (not illustrated), into which the protrusion may be inserted and fixed.

Meanwhile, in order to allow the first frame 210 and the second frame 220 to be folded and come into close contact with each other, the sum of the thickness of the first frame 210 and the thickness of the second frame 220 may be equal to or slightly greater than the length of the space 240 on the upper surface of the connection-supporting portion 230.

This is because, when the sum of the thicknesses of the first frame 210 and the second frame 220 is less than the length of the space 240 on the upper surface of the connection-supporting portion 240, even if the first and second frames 210 and 220 wholly come into close contact with each other, a gap, which corresponds to the difference between the sum of the thicknesses of the first and second frames 210 and 220 and the length of the upper surface of the connection-supporting portion 230) may be formed near the connection-supporting portion 230, which may prevent complete sealing.

As illustrated in FIG. 7, in the state in which the first frame 210 and the second frame 220 are completely tilted to be parallel with the plane, the container unit 100 may also remain in the planar state.

Accordingly, in the present invention, advantageously, the container may be used as a cutting board as needed when a storage item is placed thereon.

Figure 8:
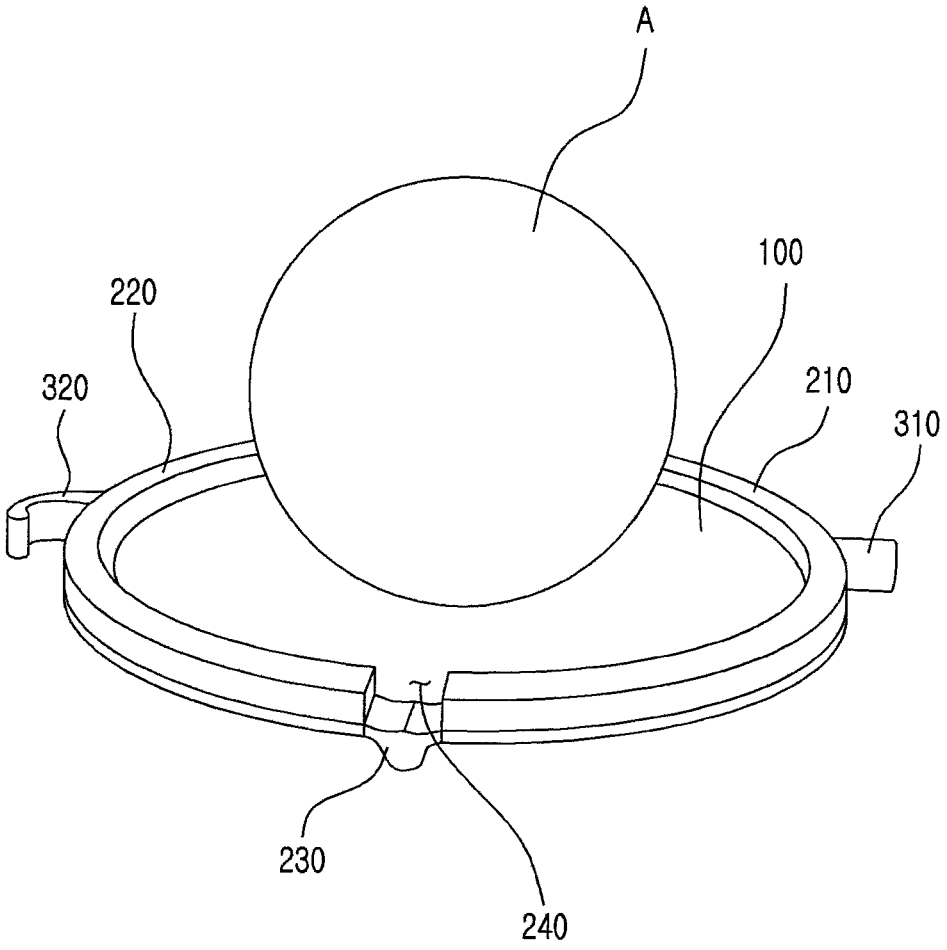
FIG. 8 is a perspective view illustrating the state in which the airtight container having the deformable container unit according to the embodiment of the present invention is fully opened and a storage item is placed therein.
Figure 9:
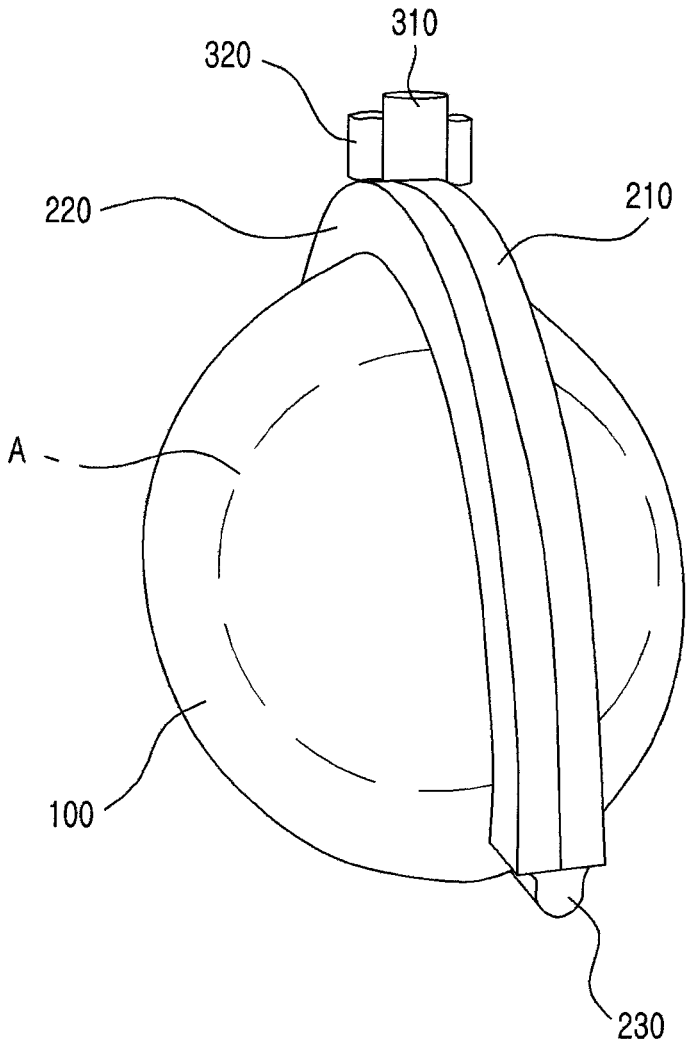
FIG. 9 is a perspective view illustrating the state in which the airtight container having the deformable container unit according to the embodiment of the present invention is closed in an airtight manner while accommodating the storage item therein.

As illustrated in FIGS. 8 and 9, in the case of an object A having a large volume, such as a watermelon, it is difficult to put the object into a conventional commercially available airtight container having a fixed shape or an airtight plastic bag such as a Ziploc bag while maintaining the original shape thereof. Thus, it is necessary to slice the watermelon in order to put it into the container.

However, in the present invention, in the state in which the first frame 210 and the second frame 220 are unfolded from each other to the maximum extent, a large storage item, such as a watermelon, or a plurality of small storage items may be put in the container unit 100.

Because the first frame 210 and the second frame 220 are pivotably connected to each other, the size of the inlet of the container unit 100 may be adjusted via adjustment in the distance between the first frame 210 and the second frame 220.

That is, although the airtight container having a fixed shape fundamentally has a fixed inlet size, and there is a limitation on the extent to which an airtight bag such as a Ziploc bag can be opened and an inlet thereof can be enlarged, in the present invention, the ability to freely enlarge the inlet of the container unit 100 is considerably increased compared to a conventional plastic airtight bag.

In this state, the user may grip and cause the first frame 210 and the second frame 220 to come into close contact with each other.

In this case, the first frame 210 and the second frame 220 are upright so that the lower ends of the first frame 210 and the second frame 220 are respectively located on the upper surface of the connection-supporting portion 230 and the first frame 210 and the second frame 220 face each other so as to come into close contact with each other.

The facing surfaces of the first frame 210 and the second frame 220 have excellent close contact ability because they may be formed of an elastic material or a viscous material, or may be respectively provided with a protrusion and a groove.

In the state in which the first frame 210 and the second frame 220 come into close contact with each other, when the connection portion 320 is pivoted to surround the fixing portion 310 or to be fastened to or connected to the fixing portion 310, the close contact state of the first frame 210 and the second frame 220 is further strengthened by the fastening or connection force.

Although FIGS. 7 to 9 illustrate that one connection portion 310 and one fixing portion 320 are provided respectively on the first frame 210 and the second frame 220, in order to increase close contact force, each of the first frame 210 and the second frame 220 may of course be provided with a plurality of connection portions or fixing portions spaced apart from each other.

Meanwhile, because the container unit 100 illustrated in FIGS. 7 to 9 includes an elastic rubber or silicon member, when the cover unit is changed from the shape of FIG. 2 to the shape of FIG. 3, the shape of the container unit 100 may be changed to correspond to the shape of the storage item A therein.

The container unit 100 may remain airtight because liquid or gas could not penetrate the cover unit.

Figure 10:
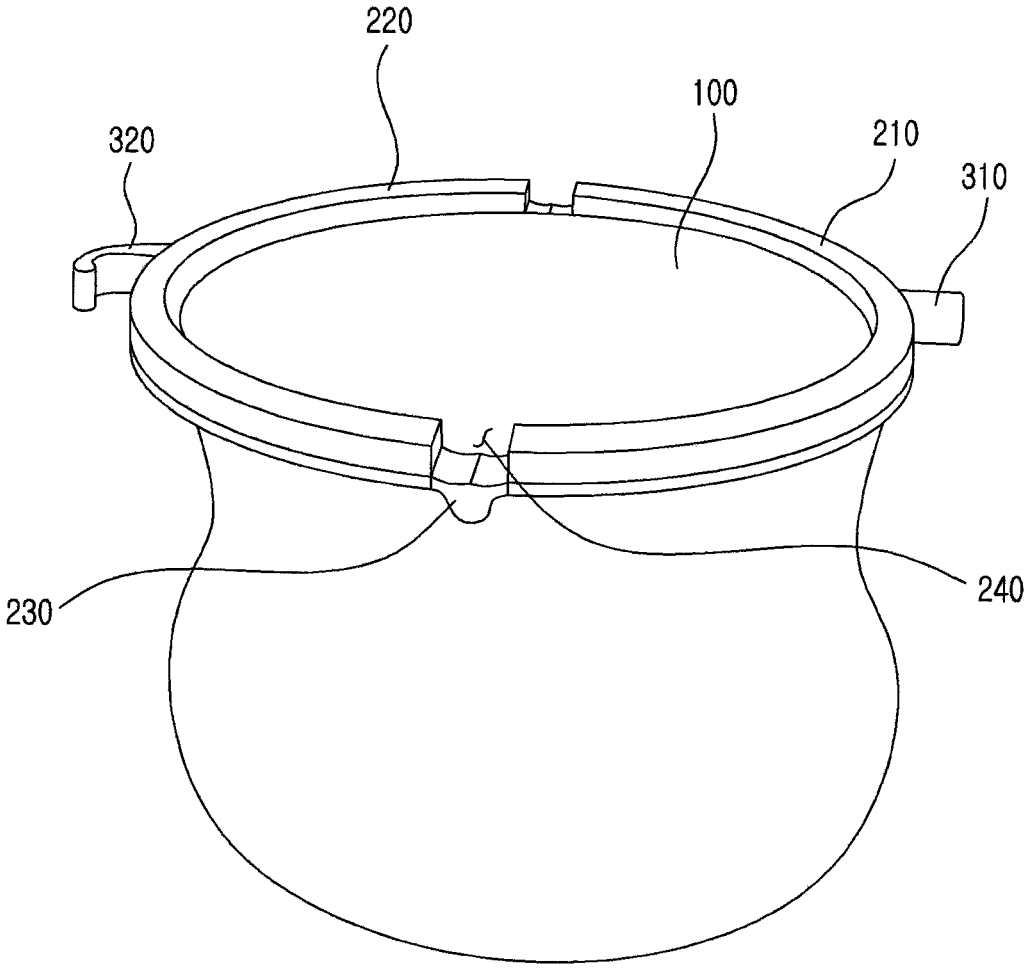
FIG. 10 is a perspective view illustrating another embodiment of the deformable container unit according to the present invention.

Meanwhile, FIG. 10 illustrates that a container unit 100' is less elastically deformable than that of FIGS. 7 to 9 and takes the form of a bag that cannot transmit liquid or gas.

Even in this case, the size of an inlet of the container unit 100' may be adjusted via adjustment of the distance between the first frame 210 and the second frame 220. When the first frame 210 and the second frame 220 are moved away from each other to the maximum extent, the size of the inlet may be maximized and the inlet may be easily maintained in the open state, which ensures easy storage of items.

In addition, when the first frame 210 and the second frame 220 are folded to come into close contact with each other and the connection portion 320 and the fixing portion 310 are fastened to, coupled to, or caught by each other, of course, the inside of the container unit 100' may be sealed from the outside.

When the airtight container illustrated in FIGS. 7 to 9 or the airtight container illustrated in FIG. 10 is washed, the container units 100 and 100' may be washed in the everted state, which ensures easy and rapid completion of washing.

Although the embodiments of the present invention have been described above in detail, it is clear that the above description is merely given to concretely describe the present invention and the present invention is not limited thereto, and that alterations or improvements thereof are possible by those skilled in the art within the scope of the present invention.

What is claimed is:

1. An airtight container adopting a deformable container unit, the container comprising:

a first frame and a second frame pivotably connected to each other so as to be selectively coupled to or come into close surface contact with each other, the first frame and the second frame being configured to airtightly seal a surface contact portion or a coupling portion therebetween when coming into surface contact with or coupled to each other; and a deformable container unit disposed over the first frame and the second frame and configured to provide an accommodating space for accommodating a predetermined storage item therein, wherein the first frame and the second frame are disposed along a rim of an inlet of the container unit, wherein both ends of the first frame are pivotably connected to both ends of the second frame so as to define a space between the first frame and the second frame, and the space is utilized as the accommodating space in which the container unit is disposed, wherein the accommodating space is enlarged or narrowed depending on adjustment of a relative pivoting angle between the first frame and the second frame so that the accommodating space has a variable volume therein and an inlet of the accommodating space has a variable size, wherein the deformable container unit is configured to be entirely flush with the first and second frames when the first and second frames are pivoted away from each other and are disposed horizontally, and wherein the deformable container unit comprises an elastic membrane deformable according to a shape of the predetermined storage item accommodated therein.

2. The airtight container according to claim 1, wherein the container unit is formed as an elastic or non-elastic bag so as to be deformable in shape, and is formed of a material that prevents penetration of liquid or gas.

3. The airtight container according to claim 1, further comprising a connection-supporting portion configured to pivotably connect the first frame and the second frame to each other.

4. The airtight container according to claim 2, wherein a sum of a thickness of the first frame and a thickness of the second frame is equal to or greater than a length of an upper surface of the connection-supporting portion.

5. The airtight container according to claim 1, further comprising:

a fixing portion provided on any one of the first frame and the second frame; and a connection portion connected to a remaining one of the first frame and the second frame so as to be caught by or fastened to the fixing portion.

6. The airtight container according to claim 5, wherein the fixing portion protrudes to extend outward, and wherein the connection portion is pivotably provided on any one of the first frame and the second frame so as to be caught by or fastened to the fixing portion.

7. The airtight container according to claim 1, wherein at least a portion of the first frame and the second frame includes a viscous component or an elastically deformable component so that the first frame and the second frame come into close contact with each other.

8. The airtight container according to claim 1, wherein the deformable container unit is configured to be entirely flat when the first and second frames are pivoted away from each other and are disposed horizontally.

9. The airtight container according to claim 1, wherein the connection-supporting portion is interposed between adjacent ends of the first and second frames.

10. The airtight container according to claim 9, wherein the connection-supporting portion includes:

a first end pivotably coupled with the end of the first frame; and a second end spaced apart from the second end and pivotably coupled with the end of the second frame.

11. The airtight container according to claim 9, wherein the adjacent ends of the first and second frames come in contact with an upper surface of the connection-supporting portion when the first and second frames are coupled to each other.

12. The airtight container according to claim 9, wherein the adjacent ends of the first and second frames spaced apart from an upper surface of the connection-supporting portion when the first and second frames are pivoted away from each other.

13. An airtight container adopting a deformable container unit, the container comprising:

a first frame and a second frame pivotably connected to each other so as to be selectively coupled to or come into close surface contact with each other, the first frame and the second frame being configured to airtightly seal a surface contact portion or a coupling portion therebetween when coming into surface contact with or coupled to each other; and a deformable container unit disposed over the first frame and the second frame and configured to provide an accommodating space for accommodating a predetermined storage item therein, wherein the first frame and the second frame are disposed along a rim of an inlet of the container unit, wherein both ends of the first frame are pivotably connected to both ends of the second frame so as to define a space between the first frame and the second frame, and the space is utilized as the accommodating space in which the container unit is disposed, wherein the accommodating space is enlarged or narrowed depending on adjustment of a relative pivoting angle between the first frame and the second frame so that the accommodating space has a variable volume therein and an inlet of the accommodating space has a variable size, wherein the deformable container unit is configured to be entirely flush with the first and second frames when the first and second frames are pivoted away from each other and are disposed horizontally, and wherein the deformable container unit is configured to be entirely flat when the first and second frames are pivoted away from each other and are disposed horizontally.

14. An airtight container adopting a deformable container unit, the container comprising:

a first frame and a second frame pivotably connected to each other so as to be selectively coupled to or come into close surface contact with each other, the first frame and the second frame being configured to airtightly seal a surface contact portion ora coupling portion therebetween when coming into surface contact with or coupled to each other; and a deformable container unit disposed over the first frame and the second frame and configured to provide an accommodating space for accommodating a predetermined storage item therein, wherein the first frame and the second frame are disposed along a rim of an inlet of the container unit, wherein both ends of the first frame are pivotably connected to both ends of the second frame so as to define a space between the first frame and the second frame, and the space is utilized as the accommodating space in which the container unit is disposed, wherein the accommodating space is enlarged or narrowed depending on adjustment of a relative pivoting angle between the first frame and the second frame so that the accommodating space has a variable volume therein and an inlet of the accommodating space has a variable size, wherein the deformable container unit is configured to be entirely flush with the first and second frames when the first and second frames are pivoted away from each other and are disposed horizontally, and wherein the connection-supporting portion is interposed between adjacent ends of the first and second frames.

15. The airtight container according to claim 14, wherein the connection-supporting portion includes:

a first end pivotably coupled with the end of the first frame; and a second end spaced apart from the second end and pivotably coupled with the end of the second frame.

16. The airtight container according to claim 14, wherein the adjacent ends of the first and second frames come in contact with an upper surface of the connection-supporting portion when the first and second frames are coupled to each other.

17. The airtight container according to claim 14, wherein the adjacent ends of the first and second frames spaced apart from an upper surface of the connection-supporting portion when the first and second frames are pivoted away from each other.

* * * * *